US006302740B1

(12) United States Patent
Holmström

(10) Patent No.: US 6,302,740 B1
(45) Date of Patent: Oct. 16, 2001

(54) SHIELDED CABLE AND CONNECTOR ASSEMBLY

(75) Inventor: Björn Holmström, Akersberga (SE)

(73) Assignee: Interconnect AB, Akersberga (SE)

( * ) Notice: Subject to any disclaimer, the term of this patent is extended or adjusted under 35 U.S.C. 154(b) by 0 days.

(21) Appl. No.: 09/173,114

(22) Filed: Oct. 15, 1998

Related U.S. Application Data

(63) Continuation of application No. PCT/SE97/00654, filed on Apr. 17, 1997, now abandoned.

(30) Foreign Application Priority Data

Apr. 18, 1996 (SE) ..... 9601479

(51) Int. Cl.[7] ..... H01R 9/03
(52) U.S. Cl. ..... 439/610; 439/98
(58) Field of Search ..... 439/98, 607–610

(56) References Cited

U.S. PATENT DOCUMENTS 2,862,993 12/1958 Schmidt .
3,404,454 10/1968 Sayles .
3,621,560 11/1971 LeBright .
4,697,339 10/1987 Verhoeven .
4,795,352 1/1989 Capp .

*Primary Examiner*—Khiem Nguyen
(74) *Attorney, Agent, or Firm*—Paul & Paul

(57) ABSTRACT

The present invention relates to a method of fabricating a shielded cable-connector assemblage (8) and to a shielded cable-connector assemblage (8) fabricated in accordance with the method. The assemblage (8) comprises at least one cable (10) which includes, among other things, conductors (12), a braided metal shield (14), and an outer mantle (16), and further comprises a connector (22). The method comprises the steps of folding a part of the braided metal shield (14) back over the outer mantle surface (16) of the cable; mounting a shielding element (20) so as to cover the whole of the junction between the backwardly folded braided metal shield (14) and the conductors (12) and to be in electrical contact with the braided metal shield (14); fitting a connector (22) to each cable (10) to form a cable-connector assembly; fixedly mounting each cable-connector assembly (10, 22) in a molding device; and molding a strain relieving element (28) such as to fill the space between the cable (10) and the connector (22) and to fixate said cable and connector in relation to one another.

8 Claims, 3 Drawing Sheets

SHIELDED CABLE AND CONNECTOR ASSEMBLY

CROSS-REFERENCE TO RELATED APPLICATIONS

This is a continuation of International Application PCT/SE97/00654, filed Apr. 17, 1997 which designated the Untied States and is now abandoned.

FIELD OF INVENTION

The present invention relates to a method of fabricating shielded cable assemblages, and to a cable and connector assemblage fabricated in accordance with the method. By cable and connector assemblage is meant an assemblage which includes one or more cable-connector assemblies.

RELATED PRIOR ART

The shielding effect provided by commercially available cable and connector assemblages, such as STP-cable and connector assemblages (Shielded Twisted Pair) and FTP-cable and connector assemblages (Foil-shielded Twisted Pair) has been found insufficient in the case of sensitive applications. Present day cable shielding is achieved, for instance, by folding back part of the braided metal shield and soldering it to a metal surface on the connector. Shielding effected in this manner has also been found insufficient.

SUMMARY OF THE INVENTION

The present inventions aims to solve these problems. This aim is achieved with a method of fabricating shielded cable and connector assemblages in accordance with claim 1 or claim 5, and with cable and connector assemblages according to claim 6 or claim 10. According to a first embodiment, the inventive method comprises the steps of folding part of the braided metal shield back over the outer mantle and then fitting a shielding element which embraces the whole of the junction area between the folded-back braided metal shield and the cable conductors and which is in electrical contact with said braided metal shield. A connector is then fitted to the cable. Each cable and connector assembly is then placed in a fixed position in a moulding device and a strain relieving element is moulded in the connector such as to fill-out the space between cable and connector and affix the same in relation to one another.

According to a first embodiment the cable and connector assemblage comprises a connector and at least one cable, which includes, among other things, conductors, a braided metal shield, and a cable mantle, wherein the cable and connector are fitted together to form a cable-connector assembly and a strain relieving element is moulded, inter alia, in the space between the cable and connector. The assemblage also includes a shielding element which fully embraces the junction between a part of the braided metal shield which has been folded back over the cable mantle and the conductors and which is in electrical contact with said braided metal shield.

According to a second embodiment, the inventive method of fabricating a shielded cable and connector assemblage comprises the steps of folding a part of the braided metal shield back over the outer mantle surface, fitting each cable with a cable connector to form a cable-connector assembly, fixating each cable and connector assembly in a moulding device and moulding a strain relieving element such as to fill-out the space between cable and connector and to affix the same in relation to one another.

According to a second embodiment of the inventive cable and connector assemblage, the assemblage comprises at least one cable, which includes conductors and a braided metal shield among other things, a connector fitted to the cable, and a strain relieving element moulded, inter alia, in the space between the cable and the connector. A part of the braided metal shield has been folded back over the outer mantle of the cable and the strain relieving element is moulded from an electrically conductive plastic material and covers the rearwardly folded braided metal shield.

The inventive methods and the inventive cable-connector assemblages provide assemblages that have splendid shielding properties and better performances than known cable-connector assemblages. This is achieved with simple and inexpensive fabrication/technical solutions. Another advantage afforded by the invention is that the cable-connector assemblages are not clamped or squeezed together during fabrication. Conventional clamping or squeezing of the conductors causes the conductors to be pressed together under pressure, resulting in deformation. This often results in cracking of the plastic ? (platsen) around the conductors.

DESCRIPTION OF EMBODIMENTS OF THE INVENTION

Figure 1:
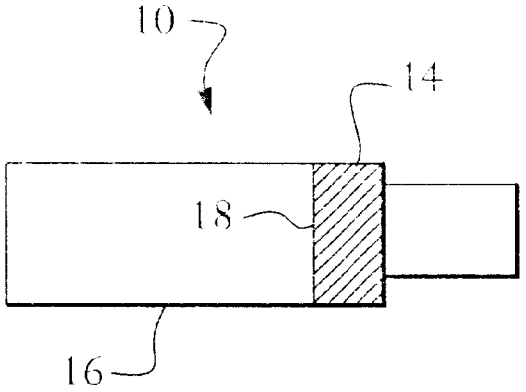
FIG. 1 is a side view of a cable connector assembly illustrating a cable with a cable mantle having a folded back braided metal shield concluding with a connection lead and connectors therein.
Figure 2:
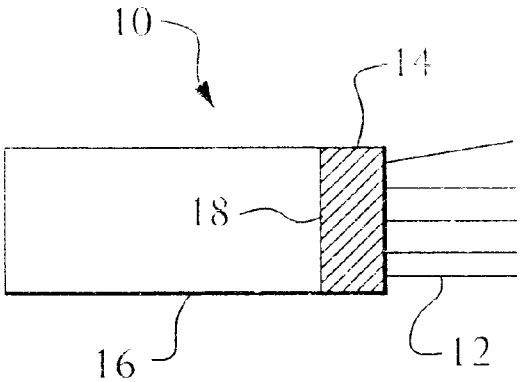
FIG. 2 is the cable of FIG. 1 illustrating bared connectors.
Figure 4:
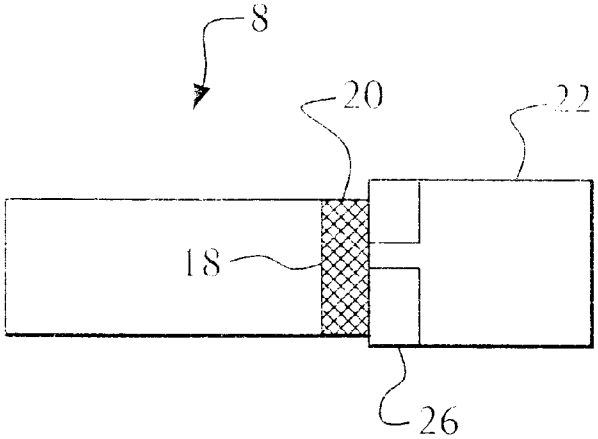
FIG. 4 is the cable of FIG. 3 illustrating the addition of the of a connector element placed over the shielding element.
Figure 3:
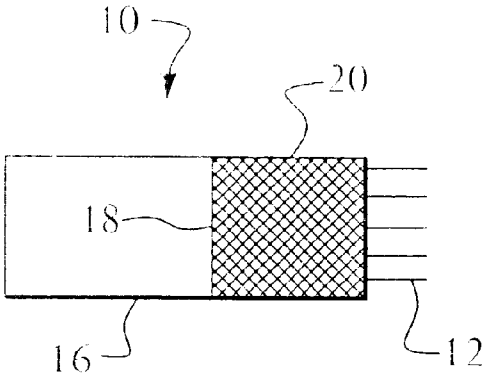
FIG. 3 is the cable of FIG. 2 illustrating the addition of a shielding element placed over the folded back braided metal shield.
Figure 5:
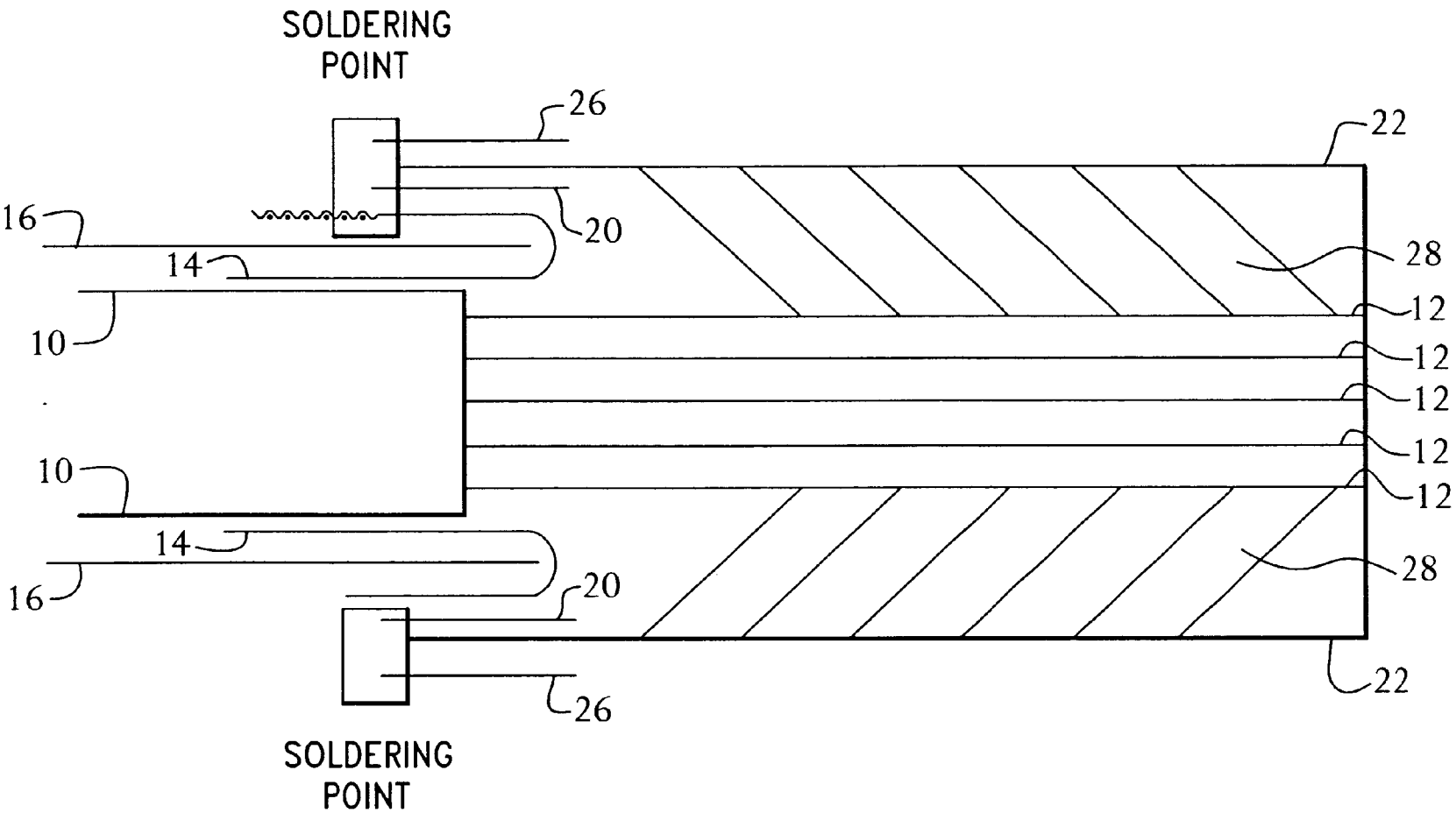
FIG. 5 is a cross-sectional view of a shielded cable-connector assemblage according to a first embodiment of the invention.

FIG. 1 is a side view showing a cable 10 in one stage of the fabrication of a shielded cable-connector assemblage according to a first embodiment of the invention. The illustrated cable 10 has an outer cable mantle 16. Part of the components of the cable 10 have been peeled off or removed with the aid of an appropriate tool and a part 14 of the braided metal shield has been folded back over the outer mantle 16 of the cable. Part of the folded-back braided metal shield 14 has also been twisted to form a connection lead 18. FIG. 2 shows the cable 10 after the conductors 12 have been bared (the cable is shown to include five conductors 12). FIG. 3 is a side view of the cable and shows the cable subsequent to having fitted a shielding element 20 thereto. As evident from FIG. 3, the shielding element embraces the cable mantle 16 and the conductors 12 and covers fully the junction between the backwardly folded braided metal shield and the conductors 12. As will also be evident from FIG. 3, The length of the shielding element 20 is adapted so as not to fully cover the connector lead 18, therewith leaving a part of the lead exposed and protruding outwards. The shielding element may comprise copper foil that has a coating of electrically conductive glue on one side thereof. The advantages of copper foil are that it has good shielding properties, can be easily shaped, and provides a good electrical contact. In the next stage of fabrication, each cable 10 is fitted with a connector 22, with the conductors 12 in place in the connector 22. A special clamping tool is then placed around the connector 22 and used to squeeze pin connectors through the conductors 12. The side view of FIG. 4 shows the state of the cable-connector assemblage 8 in this stage of its fabrication. As will be evident from FIG. 4, the connector 22 is embraced externally by a sheet metal element 26. It will be noted that the element 26 does not extend completely around the connector 22, and that its ends define a gap therebetween, as shown in the centre of the Figure. The exposed part of the connector lead 18, shown in FIG. 4, is then soldered to the copper foil 20 and to the sheet metal element 26 on the connector 22. This is done on the, for instance, on the upper sides of the assemblage 8 as shown in FIG. 4. The copper foil is soldered to the sheet metal element 26 on the connector 22 on the "underside" of the assemblage. Each thus assembled cable 10 and connector 22 is then placed fixedly in a moulding device (not shown) and a strain relieving element 28 is moulded such an to fill the space between the cable la and the connector 22 (see FIG. 5) and to affix the cable and connector in relation to one another. The strain relieving element may be moulded from an electrically conductive plastic material, therewith further enhancing the shielding properties of the cable-connector assemblage.

A second embodiment of a method of fabricating a shielded cable-connector assemblage and a shielded cable-connector assemblage fabricated in accordance with the method will now be described also with reference to FIGS. 1–5 of the accompanying drawings, even though said second embodiment differs from the first embodiment in some respects. The main differences between the first and the second embodiments is that the braided metal shield is not twisted to form a connection lead 18 and that no shielding element 20 in the form of copper foil is provided. The twisted lead 18 and the shielding element 20 can thus be deleted from the drawings with respect to an illustration of the second embodiment of the present invention. In a first stage of fabricating a cable-connector assemblage 8 according to the second embodiment, part of the cable components are peeled off or removed and part of the braided metal shield is then folded back over the cable mantle. The conductors 12 are then bared and each cable 10 is fitted with a connector 22 to form a cable-connector assembly, whereafter each cable-connector assembly is placed in a is moulding device (22) and a strain relieving element 28 is moulded so as to fill-out the space between the cable 10 and the connector 22 and to fix said cable and connector in relation to one another and to cover the backwardly folded part 14 of the braided metal shield. This results in a cable-connector assemblage 8 that has splendid shielding properties.

The cable-connector assemblage is not clamped together during its fabrication in accordance with the aforedescribed embodiments of the invention, but a strain relieving element is moulded instead, and the aforedescribed measures are implemented to provide highly effective shielding properties. By not clamping or squeezing the cable-connector assemblage together, there is obtained a contact that will remain very reliable over a long period of time, as opposed to conventional contacts.

Although the invention has been described with reference to exemplifying embodiments thereof, it will be understood that the invention is not restricted thereto and that modifications and changes can be made within the scope of the following claims.

What is claimed is:

1. A method of fabricating a shielded cable-connector assemblage (8) which comprises at least one cable (10) that includes, conductors (12) a braided metal shield (14), and an outer mantle (16), and which further comprises a connector (22), said method comprising the steps of.

folding a part of the braided metal shield (14) back over the outer mantle (16) of the cable;

twisting a part of the backwardly folded braided metal shield (14) so as to obtain a connection lead (18) that projects out from said braided metal shield (14);

mounting a shielding element (20) so as to cover the whole of the junction between the backwardly folded braided metal shield (14); and the conductors (12); and so as to be in electrical contact with the braided metal shield (14), while leaving part of the connection lead (18) exposed;

fitting a connector (22) to each cable (10) to form a cable-connector assembly;

soldering the exposed part of the connecting lead (18) to the shielding element (20);

fixedly mounting each cable-connector assembly (10), (22) in a moulding device; and moulding a strain relieving element (28) such as to fill the space between the cable (10) and the connector (22) and to fixate said cable and conductor in relation to one another.

2. A method according to claim 1, wherein the connector (22) is embraced externally by a sheet metal element (26), characterized in that the soldering step comprises:

soldering said exposed part of the connecting lead (18) to the shielding element (20) and to the sheet metal element (26); and soldering the shielding element (20) and the sheet metal element (26) together at any point wherein contact of the shielding element (20) and the sheet metal element (26) is possible without contacting the connection lead (18).

3. A method according to claim 2, characterized in that the shielding element (20) is comprised of copper foil which is coated with an electrically conductive glue on one side thereof.

4. A method according to claim 3, characterized by moulding the strain relieving element (28) from an electrically conductive plastic material.

5. An assemblage (8) fabricated by the method according to claim 1, wherein the assemblage (8) comprises at least one cable (10), said cable including, conductors (12), a braided metal shield (14) and an cuter mantle (16), and further comprises a connector (22), wherein the cable (10) and the connector (22) are fitted together to form a cable-connected assembly, and wherein a strain relieving element (28) is moulded, in the space between the cable (10) and the connector (22), characterized in that the assemblage (8) further comprises a shielding element (20) which fully embraces the junction between the braised metal shield (14) and the conductors (12) and is in electrical contact with the braided metal shield (14), a connection lead (18) which is formed from a part of the backwardly folded braided metal shield (14) and fixedly soldered to the shielding element (20).

6. An assemblage (8) according to claim 5, wherein the connector (22) is embraced externally by a sheet metal element (26), characterized in that the connection lead (18) is soldered at one point to the shielding element and to the sheet metal element (26); and in that the shielding element (20) is soldered to the sheet metal element (26) at another point.

7. An assemblage (8) according to claim 6, characterized in that the shielding element (20) is comprised of copper foil (20) which is coated with an electrically conductive glue on one side thereof.

8. An assemblage according to claim 6, characterized in that the strain relieving element (28) is moulded from an electrically conductive plastic material.

* * * * *